US008445415B2

(12) United States Patent
Mabuchi et al.

(10) Patent No.: US 8,445,415 B2
(45) Date of Patent: May 21, 2013

(54) GREASE COMPOSITION

(75) Inventors: Yutaka Mabuchi, Yokohama (JP); Akira Nakagawa, Chigasaki (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 33 days.

(21) Appl. No.: 13/058,286

(22) PCT Filed: Jul. 14, 2009

(86) PCT No.: PCT/JP2009/062699

§ 371 (c)(1),
(2), (4) Date: Feb. 9, 2011

(87) PCT Pub. No.: WO2010/024056

PCT Pub. Date: Mar. 4, 2010

(65) Prior Publication Data

US 2011/0136708 A1 Jun. 9, 2011

(30) Foreign Application Priority Data

Aug. 28, 2008 (JP) ..... 2008-219290

(51) Int. Cl.
*C10M 169/04* (2006.01)
*C10M 169/06* (2006.01)

(52) U.S. Cl.
USPC ..... 508/122; 508/113; 508/519

(58) Field of Classification Search ..... 508/122, 508/113, 519
See application file for complete search history.

(56) References Cited

U.S. PATENT DOCUMENTS

| | | | | |
|---|---|---|---|---|
| 5,840,666 | A | 11/1998 | Yokouchi et al. | |
| 6,482,779 | B2 * | 11/2002 | Naka et al. | 508/379 |
| 2007/0254817 | A1 * | 11/2007 | Griffo et al. | 508/363 |
| 2009/0018037 | A1 | 1/2009 | Mabuchi et al. | |
| 2009/0048129 | A1 | 2/2009 | Mabuchi et al. | |

FOREIGN PATENT DOCUMENTS

| | | | |
|---|---|---|---|
| EP | 1 980 609 | A1 | 10/2008 |
| JP | 4-130193 | A | 5/1992 |
| JP | 9-217752 | A | 8/1997 |
| JP | 2005-68316 | A | 3/2005 |
| JP | 2006-125437 | A | 5/2006 |
| JP | 2006-153095 | A | 6/2006 |
| JP | 2006-241443 | A | 9/2006 |
| JP | 2007-211874 | A | 8/2007 |
| WO | WO 2007/088649 | A1 | 8/2007 |

* cited by examiner

*Primary Examiner* — Prem C Singh
*Assistant Examiner* — Francis C Campanell
(74) *Attorney, Agent, or Firm* — Foley & Lardner LLP

(57) ABSTRACT

There is provided a grease composition, including: a base oil; a metal soap thickener formed of at least one metal selected from the group consisting of lithium, calcium, magnesium and aluminum and a fatty acid containing at least one selected from the group consisting of a hydroxyl group, a carboxyl group and a carboxylic acid metal salt group in each molecular structure; and nanoparticles formed of at least one selected from the group consisting of oxides, carbides and diamond materials.

3 Claims, 1 Drawing Sheet

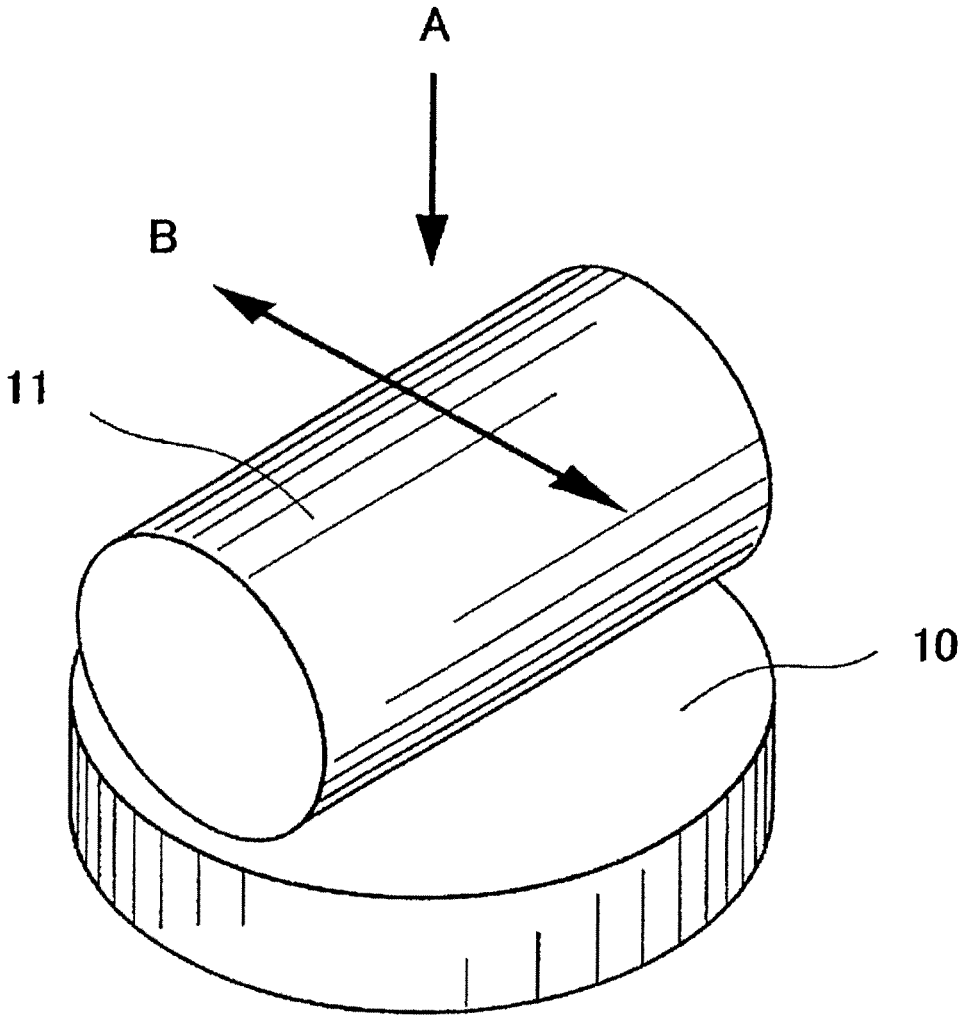
A
B
11
10

GREASE COMPOSITION

TECHNICAL FIELD

The present invention relates to a grease composition and, more particularly, to a nanoparticle-containing grease composition for application to sliding parts. The grease composition of the present invention is suitably used for lubrication of sliding parts of general industrial machines, vehicles and electrical products (e.g. sliding bearings or rolling bearings of motors) and other friction-susceptible mechanical parts.

BACKGROUND ART

Conventionally, lubricants are used in various mechanical machines so as to reduce friction coefficients of sliding mechanisms. The reduction of the friction coefficient of the sliding mechanism by improvement of the lubricant leads to not only increases in operation efficiency and part life but also decreases in noise and vibration.

There is, for example, disclosed a liquid lubricant composition that contains nanoparticles and, when applied to a steel sliding part of an internal combustion engine, can reduce a friction coefficient of the sliding part significantly for improvement in fuel efficiency (see Patent Document 1).

On the other hand, there is disclosed a grease for a constant velocity joint that contains a solid lubricity additive such as molybdenum dithiocarbamate (MoDTC), which is known as one example of organic molybdenum additive, and, especially when applied to a constant velocity joint of a vehicle drive shaft, can reduce noise caused by structural parts of the joint (see Patent Document 2).

PRIOR ART DOCUMENTS

Patent Document

Patent Document 1: Japanese Laid-Open Patent Publication No. 2006-241443

Patent Document 2: Japanese Laid-Open Patent Publication No. 4-130193

DISCLOSURE OF THE INVENTION

Problems to be Solved by the Invention

The MoDTC, when used in the grease, exerts its effect through chemical change. The effect of the MoDTC becomes thus limited during the startup or low-load operation conditions where the temperatures of the grease and the sliding parts are low. This results in a problem that the friction reduction effect of the grease cannot be obtained sufficiently depending on the conditions of use. In general, the grease is prepared by dispersing an additive or additives such as a thickener in a liquid lubricant and thereby thickening the liquid lubricant to a solid or semi-solid state. Even when the nanoparticle-containing lubricant composition is simply thickened to a grease, the resulting grease composition cannot always provide a sufficient friction reduction effect depending on the combination with the grease additive or additives.

The present invention has been made in view of the above prior art problems. It is an object of the present invention to provide a grease composition capable of showing a low friction coefficient in a wide temperature range from low to high temperatures.

Means for Solving the Problems

In order to achieve such an object, the present inventors have focused attention and made extensive researches on the low friction mechanism that involves physical adsorption and does not depend on chemical reaction. As a result, it has been found that the above object can be solved by e.g. mixing and adding, into a base oil, a metal soap thickener formed of at least one metal selected from the group consisting of lithium, calcium, magnesium and aluminum and a fatty acid containing at least one selected from the group consisting of a hydroxyl group, a carboxyl group and a carboxylic acid metal salt group in each molecular structure and nanoparticles formed of at least one selected from the group consisting of oxides, carbides and diamond materials. The present invention is based on this finding.

Namely, there is provided according to the present invention a grease composition, comprising: a base oil; a metal soap thickener formed of a salt of at least one metal selected from the group consisting of lithium, calcium, magnesium and aluminum and a fatty acid containing at least one selected from the group consisting of a hydroxyl group, a carboxyl group and a carboxylic acid metal salt group in a molecular structure thereof and/or a salt of at least one metal selected from the group consisting of lithium calcium magnesium and aluminum and a fatty acid; and nanoparticles formed of at least one selected from the group consisting of oxides, carbides and diamond materials.

BRIEF DESCRIPTION OF DRAWING

FIG. 1 is a schematic perspective view showing the procedure of SRV friction test.

BEST MODES FOR CARRYING OUT THE INVENTION

Hereinafter, the present invention will be described in detail below.

A grease composition of the present invention includes: a base oil; a metal soap thickener formed of a salt of at least one metal selected from the group consisting of lithium, calcium, magnesium and aluminum and a fatty acid containing at least one selected from the group consisting of a hydroxyl group, a carboxyl group and a carboxylic acid metal salt group in a molecular structure thereof and/or a salt of at least one metal selected from the group consisting of lithium, calcium, magnesium and aluminum and a fatty acid; and nanoparticles formed of at least one selected from the group consisting of oxides, carbides and diamond materials. The above-specified grease composition can attain a low friction efficient in a wide temperature range from low to high temperatures without using, as an essential constituent, MoDTP that exerts its effect through chemical change. Further, the above-specified grease composition becomes less susceptible to thermal deterioration and can attain improved lite as the effect of the grease composition does not involve chemical reaction.

It is currently assumed that the friction reduction and lubrication effect of the grease composition of the present invention is obtained by the following mechanism.

The metal soap thickener shows a polarity due to the presence of a hydroxyl, carboxyl and/or carboxylic acid metal salt group at the end or side chain of the molecular structure thereof and thus can be readily adsorbed onto surfaces of the high-surface-energy nanoparticles when the metal soap thickener formed of at least one metal selected from the group consisting of lithium, calcium, magnesium and aluminum and the fatty acid containing at least one selected from the group consisting of hydroxyl, carboxyl and carboxylic acid metal salt groups in each molecular structure and the nanoparticles formed of at least one selected from the group consisting of oxides, carbides and diamond materials coexist in the base oil. This allows reduction of total system energy. The resulting thickener-adsorbed nanoparticles can be dispersed in the grease composition without being agglomerated to one another. In particular, the nanoparticles onto which the thickener containing hydroxyl group, carboxyl group and/or carboxylic acid metal salt group has been adsorbed, when caught between sliding parts, can effectively prevent direct contact (metal contact) of the sliding parts. In a friction site between friction surfaces of the sliding parts, the thickener-adsorbed nanoparticles can not only prevent direct contact between surface protrusions of the friction surfaces but also get pressed against the friction surfaces, form a low-shear tribofilm and thereby reduce shear resistance between the friction surfaces. In consequence, it is possible to significantly reduce the friction coefficient of the friction site. As the surfaces of the nanoparticles are active, it is conceivable that, in a state where the nanoparticles are in powder form, any oil/fat substance derived from the manufacturing stage, the solvent and the air etc. could be adsorbed onto the surfaces of the nanoparticles and cause decrease in the surface energy of the nanoparticles. The nanoparticles however have new surfaces exposed by friction so that the hydroxyl-, carboxyl- and/or carboxylic acid metal salt-containing thickener of the grease composition can be adsorbed onto the newly exposed surfaces of the nanoparticles.

It is noted that the above mechanism is strictly based on the assumption and is needless to say that the above effect of the grease composition, even if obtained by any mechanism other than the above mechanism, falls within the technical scope of the present invention.

As the base oil, a mineral oil and/or a synthetic oil can be used. The content amount of the base oil in the grease composition is not particularly limited although it is preferable that the base oil is contained as a main component in the grease composition. Herein, the term "main component" refers to a component contained in an amount of 50 mass % or more based on the total amount of the grease composition.

Specific examples of the mineral oil are normal paraffin oils and paraffin-based or naphthene-based oils prepared by extracting oil fractions from petroleum by atmospheric or reduced-pressure distillation, and then, purifying the extracted oil fractions by any appropriate combination of purification treatments such as solvent deasphalting, solvent extraction, hydrocracking, solvent dewaxing, hydro-refining, surfuric acid washing and clay refining. Although a solvent-refined or hydro-refined mineral oil is often used as the base oil, there can also be used a mineral oil prepared by Gas-To-Liquid (GTL) wax isomerization or by deep hydrocraking for reduction of the aromatics content in the oil.

Specific examples of the synthetic oil are polyolefin (PAO) oils such as α-olefin oligomer oils and polybutene oils. There can also be used, as the synthetic oil, ester oils such as: monoester oils e.g. in which alkyl groups are added to stearic acid and oleic acid (carbon number: 10 to 20); diester oils e.g. ditridecyl glutarate, dioctyl adipate, diisodecyl adipate, ditridecyl adipate, dibutyl sebacate, di(2-ethylhexyl) sebacate, di(2-ethylhexyl) adipate, methyl acetyl ricinoleate and dioctyl sebacate; polyol ester (POE) oils e.g. trimethylolpropane caprylate, trimethylolpropane pelargonate, pentaerythritol-2-ethylhexanoate and pentaerythritol pelargonate; aromatic ester oils e.g. trioctyl trimellitate, tridecyl trimellitate and tetraoctyl pyromellitate; and complex ester oils e.g. oligoesters of mixed aliphatic acids of monobasic and dibasic acids and polyalcohols. Other specific examples of the synthetic oil are ether oils such as: polyglycols e.g. polyethylene glycol, polypropylene glycol, polyethylene glycol monoether and polypropylene glycol monoether; and phenyl ethers e.g. monoalkyl triphenyl ethers, alkyl diphenyl ethers, dialkyl diphenyl ethers, tetraphenyl ether, pentaphenyl ether, monoalkyl tetraphenyl ethers and dialkyl tetraphenyl ethers. The synthetic oil is not however limited to the above. Other synthetic oils such as perfluoroalkylether and silicon oils are also usable. These base oil compounds can be used alone or in the form of a mixture of two or more thereof.

Among others, it is preferable to use as the base oil an ester oil and/or ether oil having a hydroxyl group so that the base oil can be involved in the adsorption of the metal soap thickener onto the nanoparticles for significant reduction of the friction coefficient.

The kinematic viscosity of the base oil is not particularly limited. Preferably, the base oil has a kinematic viscosity of 2 $mm^2/s$ or higher and 20 $mm^2/s$ or lower at 100° C. It is possible to prevent dissipation of the base oil when the kinematic viscosity of the base oil is 2 $mm^2/s$ or higher at 100° C. When the kinematic viscosity of the base oil is 20 $mm^2/s$ or lower at 100° C., it is possible to secure a sufficient lubricant film thickness for reduction of metal contact and friction.

As mentioned above, the metal soap thickener needs to he formed of a salt of at least one metal selected from the group consisting of lithium, calcium, magnesium and aluminum and a fatt acid containing at least one selected from the group consisting of a hydroxyl group, a carboxyl group and a carboxylic acid metal salt group in a molecular structure thereof and/or a salt of at least one metal selected from the group consisting of lithium, calcium, magnesium and aluminum and a fatty acid. Herein, the metal soap thickener in which groups of one kind are contained falls within the technical scope of the present invention.

As the metal soap thickener, there can be used: lithium salt, calcium salt, magnesium salt and aluminum salt of higher fatty acids; or complex salt of at least one of these higher fatty acid salts and at least one of lithium salt, calcium salt, magnesium salt and aluminum salt of lower fatty acids. Preferred examples of the thickener are lithium stearate, calcium stearate, magnesium stearate, aluminum stearate and lithium hydroxystearate. The thickner is not however limited to the above.

The content amount of the thickener in the grease composition is not particularly limited. Preferably, the content amount of the thickener is 2 to 35 mass % based on the total amount of the grease composition. If the content amount of the thickener is less than 2 mass %, the thickening effect of the thickener may become small. The grease composition may become too rigid to provide a sufficient lubrication effect if the content amount of the thickener exceeds 35 mass %.

The nanoparticles need to have an average primary particle size of the order of nanometers (more specifically, an average primary particle size of 1 to 100 nm). The average primary particle size of the nanoparticles is preferably 1 to 30 nm, more preferably 1 to 10 nm, still more preferably 1 to 5 nm. If the average primary particle size of the nanoparticles is not within the above range, the nanoparticles may not contribute to significant reduction of the friction coefficient and may accelerate wear of the structural parts. The average primary particle size can be herein measured by drying the nanoparticles in powder form and observing the resulting nanoparticle powder with a transmission electron microscope (TEM).

Further, the nanoparticles needs to be formed of oxide, carbide and/or diamond material as mentioned above.

Examples of the oxide are: metal oxides such as aluminum oxide ($Al_2O_3$), titanium oxide, cerium oxide, yttrium oxide, zinc oxide, copper oxide, holmium oxide, bismuth oxide, cobalt oxide, iron oxide, manganese oxide and any mixtures thereof; non-metal oxides such as silicon oxide; and mixtures of metal oxides and non-metal oxides.

Examples of the carbide are: metal carbides such as vanadium carbide, tungsten carbide and titanium carbide; and non-metal carbides such as silicon carbide (SiC). These compounds can be used alone or in the form of a mixture of two or more thereof.

A preferred example of the diamond material is single crystal diamond. By the use of such single crystal diamond nanoparticles, it is possible that the hydroxyl-, carboxyl- and/or carboxylic acid metal salt-containing thickener can be easily adsorbed onto the nanoparticles under the action of dangling bond at a surface layer of sp3 structure for significant reduction of the friction coefficient.

In particular, the nanoparticles of the oxide, carbide or diamond material (cluster diamond) of 30 nm or smaller in average primary particle size shows a very high surface energy as a system because of the reasons that: the oxide, carbide or diamond material itself is high in surface energy; and the nanoparticles are on the order of nanometers in size and thus high in ratio of surface area to volume. The above-mentioned thickener can be more easily adsorbed onto these nanoparticles. In consequence, it is possible to significantly reduce the friction coefficient. Among others, the single crystal diamond nanoparticles of 5 nm or smaller in average primary particle size, formed by pulverizing cluster diamond and extracting only highly crystalline diamond particles and removing any amorphous component that combines the diamond particles together, show a very high surface energy so that the thickener can be easily adsorbed onto the nanoparticles under the action of dangling bond at the surface layer of sp3 structure. These nanoparticles, when caught in the friction site, can effectively prevent direct contact of the structural parts. It is thus possible that reduce the friction coefficient more significantly.

The content amount of the nanoparticles in the grease composition is not particularly limited. Preferably, the content amount of the nanoparticles is 0.001 to 0.2 mass % based on the total amount of the grease composition. If the content amount of the nanoparticles is less than 0.001 mass %, the friction coefficient may not be reduced significantly. If the content amount of the nanoparticles exceeds 0.2 mass %, the friction reduction effect does not become increased. It could cause precipitation of insoluble matter or increase of opposing material attack property rather than increase of the friction reduction effect. Further, the friction coefficient may become increased due to increases of viscosity and viscous drag of the grease composition if the content amount of the nanoparticles exceeds 0.1 mass %.

The grease composition of the present invention may preferably contain a fatty acid ester.

As the fatty acid ester, there can be used those having a linear or branched hydrocarbon group of preferably 6 to 30 carbon atoms, more preferably 8 to 24 carbon atoms, still more preferably 10 to 20 carbon atoms. The friction reduction effect may not be obtained sufficiently if the carbon number of the linear or branched hydrocarbon group of the fatty acid ester is not in the range of 6 to 30.

Specific examples of the linear or branched hydrocarbon group of 6 to 30 carbon atoms are: alkyl groups such as hexyl, heptyl, octyl, nonyl, decyl, undecyl, dodecyl, tridecyl, tetradecyl, pentadecyl, hexadecyl, heptadecyl, octadecyl, nonadecyl, icosyl, heneicosyl, docosyl, tricosyl, tetracosyl, pentacosyl, hexacosyl, heptacosyl, octacosyl, nonacosyl and triacontyl; and alkenyl groups, such as hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, icosenyl, heneicosenyl, docosenyl, tricosenyl, tetracosenyl, pentacosenyl, hexacosenyl, heptacosenyl, octacosenyl, nonacosenyl and triacontenyl. The above alkyl and alkenyl groups can have any possible linear and branched structures. Further, the positions of the double bonds in the alkenyl groups are arbitrary.

The fatty acid ester can be, for example, an ester of a fatty acid having the hydrocarbon group of 6 to 30 carbon atoms and an aliphatic monoalcohol or polyalcohol. Preferred examples of such a fatty acid ester are glycerol monooleate (GMO), glycerol dioleate, sorbitan monooleate and sorbitan dioleate. Among others, it is preferable that the fatty acid ester has a hydroxyl group so that the fatty acid ester can be involved in the adsorption of the metal soap thickener onto the nanoparticles for significant reduction of the friction coefficient.

The content amount of the fatty acid ester in the grease composition is not particularly limited. The content amount of the fatty acid ester is preferably 0.05 to 3.0 mass %, more preferably 0.1 to 2.0 mass %, still more preferably 0.5 to 1.4 mass %, based on the total amount of the grease composition. If the content amount of the fatty acid ester is less than 0.05 mass %, it is likely that the friction reduction effect will become small. If the content amount of the fatty acid ester exceeds 3.0 mass %, it is undesirably likely that a precipitate will occur due to significant decreases in the solubility and storage stability of the fatty acid ester in the base oil.

The grease composition of the present invention may further contain various additives such as an extreme pressure agent, an antioxidant, an anticorrosive agent, an adhesive and a structural stabilizer.

Examples of the extreme pressure agent are olefin sulfides, chlorinated paraffins, dialkyldithiophosphates, dialkyldithiocarbamates, phosphoric esters, molybdenum disulfide and graphites.

Examples of the antioxidant are aromatic amines such as phenyl-α-naphtylamine, phenols such as di-t-butyl-p-cresol, phenothiazines, dialkyldithiophosphates and dialkyldithiocarbamates.

Examples of the anticorrosive agent are sulfonates such as barium naphthalenesulfonate, amines such as N-alkyltrimethylenediamine dioleate and aliphatic amine-naphthenic acid condensation product, naphthenates, amino acid derivatives such as oleyl sarcosine, sodium nitrite and benzotriazoles.

Examples of the adhesive are polymers such as polyisobutylene and olefin copolymer.

Examples of the structural stabilizer are higher alcohols.

EXAMPLES

The present invention will be described in more detail by means of the following examples. It should be however noted that the following examples are only illustrative and not intended to limit the present invention thereto.

[Preparation of Grease Compositions]

Various grease compositions were prepared by the following procedures.

Example 1

The grease composition of Example 1 was prepared by using a mineral oil (kinematic viscosity: 30 $mm^2/s$ at 40° C.) as a base oil and adding to the base oil 25 mass % of lithium 12-hydroxystearate as a thickener and 0.1 mass % of SiC nanoparticles (average primary particle size: 7 nm) based on the total amount of the grease composition.

Example 2

The grease composition of Example 2 was prepared by the same procedure as that of Example 1, except for using SiC nanoparticles (average primary particle size: 28 nm) in place of the SiC nanoparticles (average primary particle size: 7 nm).

Example 3

The grease composition of Example 3 was prepared by the same procedure as that of Example 1, except for: using lithium stearate as the thickener in place of the lithium 12-hydroxystearate; and using diamond nanoparticles (average primary particle size: 5 nm, single crystal) in place of the SiC nanoparticles (average primary particle size: 7 nm).

Example 4

The grease composition of Example 4 was prepared by the same procedure as that of Example 1, except for: using diester (kinematic viscosity: 30 $mm^2/s$ at 40° C.) as the base oil in place of the mineral oil (kinematic viscosity: 30 $mm^2/s$ at 40° C.); using lithium stearate as the thickener in place of the lithium 12-hydroxystearate; and using diamond nanoparticles (average primary particle size: 5 nm, single crystal) in place of the SiC nanoparticles (average primary particle size: 7 nm).

Example 5

The grease composition of Example 5 was prepared by the same procedure as that of Example 1, except for: using PAO (kinematic viscosity: 30.6 $mm^2/s$ at 40° C.) as the base oil in place of the mineral oil (kinematic viscosity: 30 $mm^2/s$ at 40° C.); and using diamond nanoparticles (average primary particle size: 5 nm, single crystal) in place of the SiC nanoparticles (average primary particle size: 7 nm).

Example 6

The grease composition of Example 6 was prepared by the same procedure as that of Example 1, except for: using PAO (kinematic viscosity: 30.6 $mm^2/s$ at 40° C., PAO6) as the base oil in place of the mineral oil (kinematic viscosity: 30 $mm^2/s$ at 40° C.); adding 0.05 mass % of diamond nanoparticles (average primary particle size: 5 nm, single crystal), based on the total amount of the grease composition, in place of the SiC nanoparticles (average primary particle size: 7 am); and further adding 1 mass % of GMO as an additive based on the total amount of the grease composition.

Example 7

The grease composition of Example 7 was prepared by the same procedure as that of Example 1, except for: using PAO (kinematic viscosity: 30.6 $mm^2/s$ at 40° C., PAO6) as the base oil in place of the mineral oil (kinematic viscosity: 30 $mm^2/s$ at 40° C.); using calcium stearate as the thickener in place of the lithium 12-hydroxystearate; and using diamond nanoparticles (average primary particle size: 5 nm, single crystal) in place of the SiC nanoparticles (average primary particle size: 7 nm).

Example 8

The grease composition of Example 8 was prepared by the same procedure as that of Example 1, except for: using POE (kinematic viscosity: 30 $mm^2/s$ at 40° C.) as the base oil in place of the mineral oil (kinematic viscosity: 30 $mm^2/s$ at 40° C.); using aluminum stearate as the thickener in place of the lithium 12-hydroxystearate; and adding 0.04 mass % of diamond nanoparticles (average primary particle size: 5 nm, single crystal), based on the total amount of the grease composition, in place of the SiC nanoparticles (average primary particle size: 7 nm).

Example 9

The grease composition of Example 9 was prepared by the same procedure as that of Example 1, except for: using PAO (kinematic viscosity: 30.6 $mm^2/s$ at 40° C., PAO6) as the base oil in place of the mineral oil (kinematic viscosity: 30 $mm^2/s$ at 40° C.); and adding, in place of the SiC nanoparticles (average primary particle size: 7 nm), a mixture of diamond nanoparticles (average primary particle size: 5 nm, single crystal) and SiC nanoparticles (average primary particle size: 7 nm) in amounts of 0.1 mass % and 0.03 mass %, respectively, based on the total amount of the grease composition.

Example 10

The grease composition of Example 10 was prepared by the same procedure as that of Example 1, except for: using PAO (kinematic viscosity: 30.6 $mm^2/s$ at 40° C., PAO6) as the base oil in place of the mineral oil (kinematic viscosity: 30 $mm^2/s$ at 40° C.); and using $Al_2O_3$ nanoparticles (average primary particle size: 18 nm) in place of the SiC nanoparticles (average primary particle size: 7 nm).

Comparative Example 1

The grease composition of Comparative Example 1 was prepared by the same procedure as that of Example 1, except for not adding the SiC nanoparticles (average primary particle size: 7 nm).

Comparative Example 2

The grease composition of Comparative Example 2 was prepared by the same procedure as that of Example 1, except for: using aluminum stearate as the thickener in place of the lithium 12-hydroxystearate; and not adding the SiC nanoparticles (average primary particle size: 7 nm).

Comparative Example 3

The grease composition of Comparative Example 3 was prepared by the same procedure as that of Example 1, except for using SiC nanoparticles (average primary particle size: 300 nm) in place of the SiC nanoparticles (average primary particle size: 7 nm).

Comparative Example 4

The grease composition of Comparative Example 4 was prepared by the same procedure as that of Example 1, except for using $Al_2O_3$ nanoparticles (average primary particle size: 200 nm) in place of the SiC nanoparticles (average primary particle size: 7 nm).

Comparative Example 5

The grease composition of Comparative Example 5 was prepared by the same procedure as that of Example 1, except for: using POE (kinematic viscosity: 30 $mm^2/s$ at 40° C.) as the base oil in place of the mineral oil (kinematic viscosity: 30 $mm^2/s$ at 40° C.); using lithium stearate as the thickener in place of the lithium 12-hydroxystearate; and not adding the SiC nanoparticles (average primary particle size: 7 nm).

Comparative Example 6

The grease composition of Comparative Example 6 was prepared by the same procedure as that of Example 1, except for: using diester (kinematic viscosity: 30 $mm^2/s$ at 40° C.) as the base oil in place of the mineral oil (kinematic viscosity: 30 $mm^2/s$ at 40° C.); using lithium stearate as the thickener in place of the lithium 12-hydroxystearate; and not adding the SiC nanoparticles (average primary particle size: 7 nm).

Comparative Example 7

The grease composition of Comparative Example 7 was prepared by the same procedure as that of Example 1, except for: using PAO (kinematic viscosity: 30.6 $mm^2/s$ at 40° C., PAO6) as the base oil in place of the mineral oil (kinematic viscosity: 30 $mm^2/s$ at 40° C.); not adding the SiC nanoparticles (average primary particle size: 7 nm); and adding 1 mass % of GMO as an additive based on the total amount of the grease composition.

Comparative Example 8

The grease composition of Comparative Example 8 was prepared by the same procedure as that of Example 1, except for: using PAO (kinematic viscosity: 30.6 $mm^2/s$ at 40° C., PAO6) as the base oil in place of the mineral oil (kinematic viscosity: 30 $mm^2/s$ at 40° C.); using calcium stearate as the thickener in place of the lithium 12-hydroxystearate; and not adding the SiC nanoparticles (average primary particle size: 7 nm).

Comparative Example 9

The grease composition of Comparative Example 9 was prepared by the same procedure as that of Example 1, except for: using PAO (kinematic viscosity: 30.6 $mm^2/s$ at 40° C., PAO6) as the base oil in place of the mineral oil (kinematic viscosity: 30 $mm^2/s$ at 40° C.); not adding the SiC nanoparticles (average primary particle size: 7 nm); and adding as an additive 0.07 mass % of MoDTC in terms of Mo weight part based on the total amount of the grease composition.

[Performance Evaluation]

[Preparation of Test Pieces]

As one example to embody a low-friction system with contact surfaces, there were prepared test pieces for a SRV friction tester manufactured by Optimol Inc.

FIG. 1 is a perspective schematic view showing the procedure of SRV friction test. As shown in FIG. 1, a disk 10 (diameter: 22 mm, thickness: 7.9 mm) and a pin 11 (diameter: 15 mm, length: 22 mm) were formed of SUJ2 material and used as the test pieces. Both of the disk 10 and the pin 11 were polished to a surface roughness Ra of about 0.05.

[SRV Friction Test]

The prepared test pieces were set in the Optimol SRV friction tester and subjected to SRV friction test under the following conditions with the application of the grease composition of each example to a friction part of the disk. The SRV friction test was herein conducted by placing the pin 11 on the surface of the disk 10 and, while applying a load to the pin 11 in the direction of an arrow A (vertical direction), sliding the pin 11 on the surface of the disk 11 in the direction of an arrow B (horizontal direction) as shown in FIG. 1.

[Test Conditions]

Temperature: 40° C.

Load: 100 N

Amplitude: 3 mm

Frequency: 10 Hz

Test time: 30 minutes

Lubrication method: The grease composition was applied in an amount of 0.2 to 0.3 $cm^3$ onto the disk friction part before the test.

The friction coefficient of the disk friction part was measured during the SRV friction test; and the maximum wear amount of the disk friction part was measured after the SRV friction test. Herein, the "friction coefficient" refers to the average friction coefficient value of the disk friction part during last 5 minutes of the test; and the "maximum wear amount" refers to the maximum amount (depth) of wear of the disk friction part as determined by step profile measurement with respect to the non-sliding part.

The component ratios of the grease composition of each example and the evaluation results of the grease composition of each example (the friction coefficient of the disk friction part measured during the SRV friction test and the maximum wear amount of the disk friction part measured after the SRV friction test) are indicated in TABLE 1.

TABLE 1

| | | | Nanoparticles | | |
|---|---|---|---|---|---|
| | Base oil | Thickener | Kind | Average primary particle size (nm) | Content (mass %) |
| Example 1 | Mineral oil | Lithium 12-hydroxystearate | SiC | 7 | 0.1 |
| Example 2 | Mineral oil | Lithium 12-hydroxystearate | SiC | 28 | 0.1 |
| Example 3 | Mineral oil | Lithium stearate | Diamond | 5 | 0.1 |
| Example 4 | Diester | Lithium stearate | Diamond | 5 | 0.1 |
| Example 5 | PAO | Lithium 12-hydroxystearate | Diamond | 5 | 0.1 |
| Example 6 | PAO | Lithium 12-hydroxystearate | Diamond | 5 | 0.05 |
| Example 7 | PAO | Calcium stearate | Diamond | 5 | 0.1 |
| Example 8 | POE | Aluminum stearate | Diamond | 5 | 0.04 |
| Example 9 | PAO | Magnesium stearate | Diamond | 5 | 0.1 |
| | | | SiC | 7 | 0.03 |
| Example 10 | PAO | Lithium 12-hydroxystearate | $Al_2O_3$ | 18 | 0.1 |

TABLE 1-continued

| | | | | | |
|---|---|---|---|---|---|
| Comprative Example 1 | Mineral oil | Lithium 12-hydroxystearate | — | — | — |
| Comprative Example 2 | Mineral oil | Aluminum stearate | — | — | — |
| Comprative Example 3 | Mineral oil | Lithium 12-hydroxystearate | SiC | 300 | 0.1 |
| Comprative Example 4 | Mineral oil | Lithium 12-hydroxystearate | $Al_2O_3$ | 200 | 0.1 |
| Comprative Example 5 | POE | Lithium stearate | — | — | — |
| Comprative Example 6 | Diester | Lithium stearate | — | — | — |
| Comprative Example 7 | PAO | Lithium 12-hydroxystearate | — | — | — |
| Comprative Example 8 | PAO | Calcium stearate | — | — | — |
| Comprative Example 9 | PAO | Lithium 12-hydroxystearate | — | — | — |

| | Additive | Friction coefficient | Maximum disk wear amount (μm) |
|---|---|---|---|
| Example 1 | — | 0.063 | 3 |
| Example 2 | — | 0.077 | 9 |
| Example 3 | — | 0.054 | <1 |
| Example 4 | — | 0.035 | <1 |
| Example 5 | — | 0.042 | <1 |
| Example 6 | GMO | 0.022 | <1 |
| Example 7 | — | 0.051 | <1 |
| Example 8 | — | 0.056 | <1 |
| Example 9 | — | 0.053 | <1 |
| Example 10 | — | 0.073 | 5 |
| Comprative Example 1 | — | 0.144 | <1 |
| Comprative Example 2 | — | 0.143 | <1 |
| Comprative Example 3 | — | 0.112 | 500 |
| Comprative Example 4 | — | 0.122 | 180 |
| Comprative Example 5 | — | 0.118 | <1 |
| Comprative Example 6 | — | 0.123 | <1 |
| Comprative Example 7 | GMO | 0.098 | <1 |
| Comprative Example 8 | — | 0.145 | <1 |
| Comprative Example 9 | MoDTC | 0.083 | <1 |

As shown in TABLE 1, the friction coefficient was lower in each of Examples 1 and 2 using the SiC nanoparticles and in Example 10 using the $Al_2O_3$ nanoparticles than in Comparative Examples 1 to 9. The friction efficient was still lower in each of Examples 3 to 9 using the single crystal diamond nanoparticles. Among others, the friction coefficient was much lower in Example 4 using one kind of ester oil, diester, as the base oil, in Example 8 using POE as the base oil and in Example 6 using one kind of fatty acid ester friction modifier, GMO, as the additive than in the other examples. In Example 9 where two kinds of nanoparticles were dispersed, the friction efficient was also much lower, as in the case of the other examples, than in Comparative Examples 1 to 9. It has thus been shown that each of the grease compositions of Examples 1 to 10 had a greater friction reduction and lubrication effect than those of Comparative Examples 1 to 9.

The grease compositions of Comparative Examples 1, 2 and 5 to 8, each of which contained no nanoparticles, showed a high friction coefficient of 0.1 to 0.14. In particular, it is apparent from Comparative Examples 5 and 6 using the ester oil as the base oil that the friction coefficient could not be lowered to the level of Examples 1 to 10 only by the change of the base oil. It is also apparent from Comparative Example 7 using one kind of fatty acid ester, GMO, as a friction modifier that the friction coefficient could not be lowered to the level of Examples 1 to 10 only by the improvement of the friction modifier. The grease compositions of Comparative Examples 3 and 4, in which the SiC particles and $Al_2O_3$ particles having a large average primary particle size of 200 to 300 nm were contained, respectively, showed a low friction coefficient after the test (not shown in the table). In Comparative Examples 3 and 4, however, the friction coefficient was increased in the later stage of the test due to surface roughness deterioration caused by friction and reached a much higher level than in Examples 1 to 10. In addition, the wear amount after the test was at a significantly large level, impractical for use as the grease composition, in Comparative Examples 3 and 4. The grease composition of Comparative Example 9, in which MoDTC was added as in conventional types, showed a higher friction coefficient than those of Examples 1 to 9 and did not exert its effect sufficiently under the low-temperature conditions such as the above test conditions.

As described above, the grease composition of the present invention is prepared by adding and mixing, into the base oil, the metal soap thickener formed of at least one metal selected from the group consisting of lithium, calcium, magnesium and aluminum and the fatty acid containing at least one selected from the group consisting of hydroxyl, carboxyl and carboxylic acid metal salt groups in each molecular structure and the nanoparticles formed of at least one selected from the group consisting of oxides, carbides and diamond materials. It is therefore possible that the grease composition of the present invention can attain a low friction efficient in a wide temperature range from low to high temperatures. It is also possible that the grease composition of the present invention can be made less susceptible to thermal deterioration and can attain improved life as the effect of the grease composition does not involve chemical reaction.

Industrial Applicability

Although the present invention has been described with respect to the above specific embodiments, the present invention is not limited to those embodiment. Various modifications and changes of the embodiments will occur without departing from the scope of the present invention.

The grease composition of the present invention can be applied, without particular limitations, to relatively movable opposing contact surfaces of various mechanical machines where low friction performance is required. Further, the grease composition of the present invention can widely contribute to energy-conservation measures in various fields. For example, the application of the grease composition of the present invention to a constant velocity joint enables low friction performance and makes it possible to prevent vibration during operation in all operation ranges.

The invention claimed is:

1. A grease composition, comprising:

a base oil;

a metal soap thickener selected from the group consisting of lithium 12-hydroxystearate, lithium stearate, calcium stearate, magnesium stearate, and aluminum stearate; and nanoparticles formed of single crystal diamond and have an average primary particle size of 5 nm or smaller, wherein the grease composition does not include organic molybdenum.

2. The grease composition according to claim 1, wherein the base oil contains at least one selected from ester oils, ether oils and polyolefin oils.

3. The grease composition according to claim 1, further comprising a fatty acid ester.

* * * * *